US008044562B2

(12) United States Patent
Musasa et al.

(10) Patent No.: US 8,044,562 B2
(45) Date of Patent: Oct. 25, 2011

(54) SPARK PLUG

(75) Inventors: Mamoru Musasa, Nagoya (JP); Naomichi Miyashita, Kasugai (JP); Kazuyoshi Torii, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/741,764

(22) PCT Filed: Nov. 12, 2008

(86) PCT No.: PCT/JP2008/070605

§ 371 (c)(1),
(2), (4) Date: May 6, 2010

(87) PCT Pub. No.: WO2009/063914

PCT Pub. Date: May 22, 2009

(65) Prior Publication Data

US 2010/0264796 A1 Oct. 21, 2010

(30) Foreign Application Priority Data

Nov. 15, 2007 (JP) ..... 2007-297360

(51) Int. Cl.
*H01T 13/20* (2006.01)

(52) U.S. Cl. ..... 313/141; 313/142

(58) Field of Classification Search ..... None
See application file for complete search history.

(56) References Cited

U.S. PATENT DOCUMENTS

| | | | | |
|---|---|---|---|---|
| 5,578,895 | A | 11/1996 | Oshima | |
| 2007/0128964 | A1 * | 6/2007 | Hori | 445/7 |
| 2007/0216277 | A1 * | 9/2007 | Yoshida et al. | 313/141 |
| 2009/0033195 | A1 * | 2/2009 | Kameda | 313/141 |

FOREIGN PATENT DOCUMENTS

| | | | |
|---|---|---|---|
| JP | 57-040885 | A | 3/1982 |
| JP | 61-168622 | U | 10/1986 |
| JP | 04-264378 | A | 9/1992 |
| JP | 07-037674 | A | 2/1995 |
| JP | 2003-249325 | A | 9/2003 |
| JP | 2004-134209 | A | 4/2004 |
| JP | 2005-203110 | A | 7/2005 |
| JP | 2006-316344 | A | 11/2006 |

* cited by examiner

*Primary Examiner* — Ashok Patel
(74) *Attorney, Agent, or Firm* — Sughrue Mion, PLLC

(57) ABSTRACT

There is provided a spark section (80) of needle-like shape protruding from an inner surface (33) of a ground electrode (30) to define a spark gap between the spark section and an electrode tip on a center electrode. The spark section (80) has a noble metal member (81) and an intermediate member (86) joined to each other. The materials of the noble metal member (81) and the intermediate member (86) are selected in such a manner that the thermal conductivity of the intermediate member (86) is lower than that of the noble metal member (81). This limits heat radiation through the heat radiation passage from the noble metal member (81) through the intermediate member (86) to the ground electrode (30) so as to maintain the noble metal member (81) at a higher temperature than conventional types and reduce a quenching effect of the noble metal member (81) on a flame core generated in the spark gap for improvement in ignition performance.

6 Claims, 7 Drawing Sheets

SPARK PLUG

TECHNICAL FIELD

The present invention relates to a spark plug in which a needle-like shaped spark section is disposed on a ground electrode to define a spark gap between the spark section and a center electrode.

BACKGROUND ART

A spark plug is known, which includes a center electrode, a ground electrode and a needle-like shaped spark section disposed on an inner surface (one side surface) of an end portion of the ground electrode facing the center electrode so as to define a spark gap between the spark section and the center electrode. (See e.g. Patent Document 1.) Herein, the needle-like shaped spark section refers to that, for example, having a protrusion length of 0.6 to 1.6 mm from the inner surface of the ground electrode and an outer diameter (or protruding end face diameter) of 0.5 to 1.2 mm. The spark plug with such a needle-like shaped spark section allows the ground electrode to be located away from the spark gap and reduces the tendency that a flame core generated in the spark gap comes into contact with the ground electrode in the initial stage of flame growth as compared to conventional spark plugs. This makes it possible to decrease a so-called quenching effect of interfering with the flame growth by heat loss upon contact of the flame core with the ground electrode and thereby makes it possible to improve the ignition performance of the spark plug.

The spark section is generally formed using a noble metal having high resistance to spark wear by a concentration of spark discharges. However, there is a large difference between the linear expansion coefficient of the noble metal and the liner expansion coefficient of e.g. nickel-based alloy material commonly used for the ground electrode. If these materials are simply joined together, a crack or separation may occur in the joint between the materials under the influence of thermal load by cooling/heating cycles. Against such a backdrop, Patent Document 1 teaches that the spark section has a noble metal member and an intermediate member having a linear expansion coefficient between those of the noble metal member and the ground electrode and joined to the noble metal member and to the ground electrode so as to increase the joint strength between the spark section and the ground electrode.

In recent years, the combustion conditions of an engine have become increasingly strict for high engine performance and fuel efficiency. This leads to an increase in the amount of heat applied to the ground electrode of the spark plug and an increase in the influence of thermal load applied to the spark section by cooling/heating cycles. As the noble metal member gets heated to a high temperature, it becomes likely that the noble metal member will be consumed by oxidation to cause a deterioration of spark wear resistance. Various modifications have heretofore been made on the spark plug so as to enable rapid heat radiation from the spark section, such as by providing a core material of high thermal conductivity in the ground electrode or by increasing the heat radiation ability of the intermediate member to enhance heat radiation from the noble metal member.

On the other hand, the engine has an exhaust gas passage (exhaust pipe) equipped with a three-way catalyst. This three-way catalyst is activated at a high temperature so as to purify exhaust gas. It is thus common to perform engine control (so-called retard ignition control) that retards the ignition from the normal ignition timing and thereby raises the exhaust gas temperature under low-temperature conditions such as during engine start (e.g. for a lapse of 1 to 2 minutes from turning on the ignition key) so that the high-temperature exhaust gas can be fed to the catalyst to allow early activation of the catalyst and to reduce HC emissions by secondary combustion.

Patent Document 1: Japanese Laid-Open Patent Publication No. 2004-134209.

DISCLOSURE OF THE INVENTION

Problems to be Solved by the Invention

However, the ignition is unlikely to occur due to inadequate fuel vaporization in the case where the retard ignition control is performed for early catalyst activation at the engine start where the engine itself has not been sufficiently warmed up. Further, the flow of air-fuel mixture in the combustion chamber becomes more turbulent so that the combustion state of the engine tends to be unstable when the ignition occurs after the piston top dead center under the retard ignition control than under the normal ignition operation although the retard ignition control increases the exhaust gas temperature according to the degree of retardation of the ignition timing to promote secondary combustion and reduce HC emissions more effectively. In order to improve the stability of the engine combustion state, while increasing the degree of retardation of the ignition timing for earlier activation of the catalyst and efficient reduction of HC emissions, under the retard ignition control, it has been required that the spark plug attains high ignition performance.

The present invention has been made in view of the above problems. It is an object of the present invention to provide a spark plug capable of limiting heat radiation from a noble metal member to maintain the noble metal member at a high temperature, as well as increasing the temperature in the vicinity of a spark gap to reduce a quenching effect, for improvement of ignition performance.

According to one configuration of the present invention, there is provided a spark plug, comprising: a center electrode; a ceramic insulator having an axial hole extending in an axial direction and retaining the center electrode in the axial hole; a metal shell circumferentially surrounding and retaining therein the ceramic insulator; a ground electrode joined at one end portion thereof to a front end face of the metal shell and bent in such a manner that a side surface of the other end portion of the ground electrode faces a front end portion of the center electrode; and a spark section joined to the side surface of the other end portion of the ground electrode at a position facing the front end portion of the center electrode and protruding 0.6 to 1.6 mm from the side surface toward the center electrode, the spark section comprising: an intermediate member containing nickel as a main component, joined to the side surface and protruding toward the center electrode; a noble metal member containing a noble metal as a main component and joined to a protruding end of the intermediate member so as to define a spark gap between the noble metal member and the front end portion of the center electrode, a portion of the noble metal member adjacent to a fused joint between the noble metal member and the intermediate member having an outer diameter Dp of 0.5 to 1.2 mm, wherein a thermal conductivity of the intermediate member is lower than a thermal conductivity of the noble metal member.

In the above configuration of the present invention, the spark section of the spark plug is characterized in that the thermal conductivity of the intermediate member is lower than that of the noble metal member so as to limit heat radiation (heat transfer) via the heat radiation passage from the noble metal member through the intermediate member to the ground electrode. This allows heat accumulation in the noble metal member whereby the noble metal member can be maintained at a high temperature. It is thus unlikely that, even when a flame core generated by a spark discharge comes into contact with the noble metal member in the initial stage of flame growth, heat loss will occur in the flame core to interfere with the flame growth. It is accordingly possible to improve the ignition performance of the spark plug.

The term "main component" herein refers to a component (element or compound) having the highest content (% by weight) among all of constituent components of a material. It means that, when a material contains nickel as a main component, the content of the nickel element is higher than the contents of the other constituent components. When a material contains a nickel compound as a main component, it means that the content of the nickel compound, rather than the content of the nickel element, is higher than the contents of the other constituent components. When a material contains a noble metal as a main component, it means that the total content of any element(s) or compound(s) classified as the noble metal is higher than the contents of the other constituent components. For example, in the case of a material of 40Pt-20Rh-40Ni, the total content of Pt and Rb classified as the noble metal is higher than the content of Ni so that the noble metal is determined as the main component of the material.

Preferably, the thermal conductivity of the intermediate member is in the range of 10 to 25 W/(m·K) in the above configuration of the present invention. When the thermal conductivity of the intermediate member is lower than or equal to 25 W/(m·K), the heat radiation from the noble metal member through the intermediate member to the ground electrode can be limited effectively to maintain the noble metal member at a higher temperature. It is thus possible for the spark plug to obtain the same ignition performance as that of the current spark plug product even when the ignition advance is retarded 1 degree or more. It is known that, when the ignition advance is retarded 1 degree, there can be obtained an effect of about 10% reduction in HC emissions.

As the temperature of the noble metal member increases, the noble metal member becomes more susceptible consumption by oxidation and thereby results in a deterioration of spark wear resistance. When the thermal conductivity of the intermediate member is higher than or equal to 10 W/(m·K), it is possible to limit the deterioration of spark wear resistance and secure the same level of spark wear resistance as that of the current product (including such a level of spark wear resistance that, even if lower than that of the current product, will not cause a deterioration in performance).

The intermediate member also preferably has a length of 0.2 to 1.4 mm in a protruding direction thereof from the side surface (hereinafter referred to as "protrusion length") in the above configuration of the present invention. The length of the thermal radiation passage through the intermediate member decreases with the protrusion length of the intermediate member. When the protrusion length of the intermediate member is smaller than 0.2 mm, it is difficult to limit the heat radiation from the noble metal member through the intermediate member sufficiently for ignition performance improvement. The protrusion length of the intermediate member is thus preferably set to be at least 0.2 mm or larger. As the protrusion length of the intermediate member increases, the heat radiation from the noble metal member becomes more limited so that the spark wear resistance deteriorates with increase in the temperature of the noble metal member. Thus, the protrusion length of the intermediate member is preferably set to be 1.4 mm or smaller in order to obtain the same level of spark wear resistance as that of the current product (including such a level of spark wear resistance that, even if lower than that of the current product, will not cause a deterioration in performance).

Further, the spark section preferably satisfies a relationship of $-0.1 \leqq Dn-Dp \leqq 0.5$ where Dn is an outer diameter of the intermediate member before being joined in the above configuration of the present invention. When the outer diameter Dn of the intermediate member is set large relative to the outer diameter Dp of the noble metal member, the heat radiation from the noble metal member through the intermediate member can be enhanced with increase in the cross-sectional area of the heat radiation passage. On the other hand, the ignition performance of the spark plug may deteriorate due to the difficulty of maintaining the noble metal member at the high temperature. In order for the spark plug to obtain the same or higher level of ignition performance than that of the current product even when the ignition advance of the spark plug is more retarded than that of the current product, it is preferable to set the outer diameter difference Dn−Dp between the outer diameter Dp of the noble metal member and the outer diameter Dn of the intermediate member to be 0.5 mm or smaller. As the difference Dn−Dp decreases, the heat radiation from the noble metal member through the intermediate member becomes more limited so that the spark plug can obtain higher ignition performance. However, the size of the noble metal member relative to the intermediate member increases as the outer diameter Dp of the noble metal member becomes larger than the outer diameter Dn of the intermediate member. This raises a possibility that the noble metal member falls off with the application of larger load to the joint between the noble metal member and the intermediate member by engine vibrations. In order to prevent such a problem, it is preferable to set the outer diameter difference Dn−Dp between the outer diameter Dp of the noble metal member and the outer diameter Dn of the intermediate member to be −0.1 mm or larger.

Furthermore, the fused joint is preferably formed by laser welding or electron beam welding in such a manner that a cross section of the spark section taken through a center axis of the spark section has a contour including a segment of either linear shape or arc shape concave toward the center axis at a position corresponding to the fused joint in the above configuration of the present invention. The heat radiation from the noble metal member through the intermediate member to the ground electrode is also largely influenced by the outer profile (cross-sectional contour) of the fused joint between the noble metal member and the intermediate member. When the outer profile of the fused joint is of linear shape or inwardly concave arc shape, the heat radiation passage from the noble metal member to the intermediate member can be narrowed at a position closer to the noble metal member (i.e. at a more upstream position) than the case of outwardly convex shape so as to limit the heat radiation more effectively. It is thus possible that the spark plug can obtain higher ignition performance.

The spark section also preferably satisfies a relationship of $Sy/Sn \geqq 0.55$ where Sy is an area of a cross section of the spark section taken perpendicular to the center axis and including the fused joint at a position that the area of the cross section becomes minimum; and Sn is an area of a cross section of the spark section taken perpendicular to the center axis and including only the intermediate member at position closest to the fused joint in the direction of the center axis in the above configuration of the present invention. The above configuration of the present invention is intended to improve the ignition performance of the spark plug in the same manner against any materials, without being limited to the materials of the spark section and the intermediate member, and to improve the stability of the combustion state under the retard ignition control. On the other hand, there arises a fear that the noble metal member may be consumed early after the stabilization of the combustion when the heat radiation from the noble metal member is too limited. The spark section, when satisfying the relationship of $Sy/Sn \geqq 0.55$, can prevent the outer diameter of the fused joint from being extremely small relative to the outer diameter of the intermediate member and can secure the heat radiation from the noble metal member to the intermediate member. It is thus possible to improve the ignition performance of the spark plug while avoiding excessive consumption of the noble metal member.

BEST MODES FOR CARRYING OUT THE INVENTION

A spark plug in which the present invention is embodied will be described below with reference to the drawings. First, the structure of a spark plug 100 according to one embodiments of the present invention will be explained with reference to FIGS. 1 and 2. Herein, the direction of an axis of the spark plug 100 is defined as a vertical direction in FIGS. 1 and 2 where the bottom and top sides refer to the front and rear of the spark plug 100, respectively.

Figure 1:
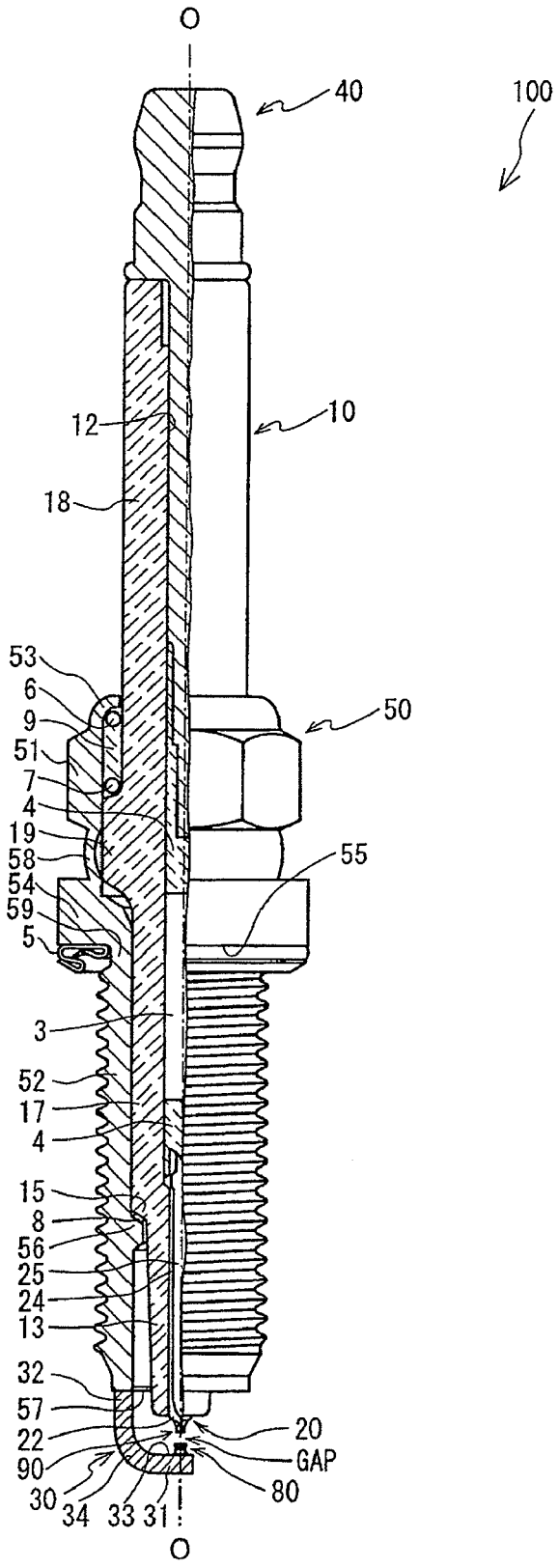
FIG. 1 is a section view of part of a spark plug 100 according to one embodiment of the present invention.

As shown in FIG. 1, the spark plug 100 generally includes a ceramic insulator 10 provided with an axial hole 12, a center electrode 20 retained in a front side of the axial hole 12, a metal terminal 40 retained in a rear side of the axial hole 12 and a metal shell 50 surrounding a radial outer circumference of the ceramic insulator 10. The spark plug 100 further includes a ground electrode 30 joined at one end portion thereof to a front end face 57 of the metal shell 50 and bend in such a manner that the other end portion (front end portion 31) of the ground electrode 30 faces a front end portion 22 of the center electrode 20.

The ceramic insulator 10, which constitutes an insulator of the spark plug 100, will be first explained in detail below. The ceramic insulator 10 is made of sintered alumina etc. as is commonly known and is formed into a cylindrical shape in which the axial hole 12 extends through the center of the insulator 10 along the direction of the axis O. The ceramic insulator 10 includes a flange portion 19 located at a substantially middle position of the direction of the axis O and having the largest outer diameter, a rear body portion 18 located on a rear side of the flange portion 19 (top side in FIG. 1), a front body portion 17 located on a front side of the flange portion 19 (bottom side in FIG. 1) and having a smaller outer diameter than that of the rear body portion 18 and a leg portion 13 located on a front side of the front body portion 17 and having a smaller outer diameter than that of the front body portion 17. The leg portion 13 decreases in diameter toward the front and, when the spark plug 100 is mounted on an cylinder head of an internal combustion engine (not shown), gets exposed to the inside of a combustion chamber of the engine. The ceramic insulator 10 also includes a stepped portion 15 between the leg portion 13 and the front body portion 17.

Figure 2:
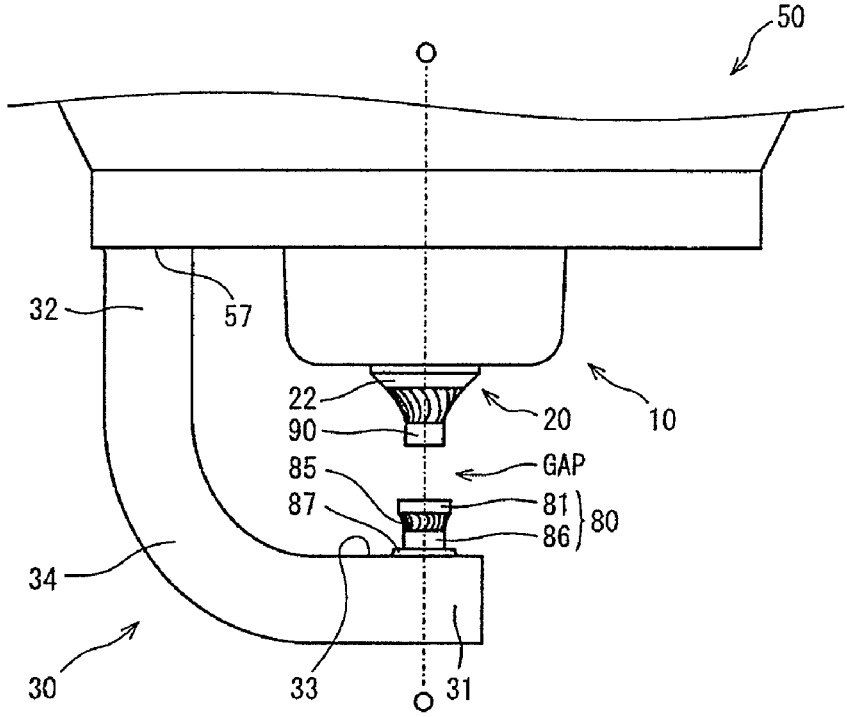
FIG. 2 is an enlarged section view of the vicinity of a spark gap GAP of the spark plug 100.

The center electrode 20 will be next explained in detail below. The center electrode 20 is designed as a rod-shaped electrode including a body material 24 formed of nickel or nickel-based alloy such as Inconel 600 or 601 (trademark) and a core material 25 formed of copper or copper-based alloy having a higher thermal conductivity than that of the body material 24 and embedded in the body material 24. The center electrode 20 is retained in the front side of the axial hole 12 of the ceramic insulator 10, with the front end portion 22 of the center electrode 20 protruding toward the front from a front end of the ceramic insulator 10 as shown in FIG. 2. The front end portion 22 of the center electrode 20 decreases in diameter toward the front. For improvements in spark wear resistance, an electrode tip 90 of noble metal is joined to a front end face of the front end portion 22 of the center electrode 20.

As shown in FIG. 1, the center electrode 20 is electrically connected at a rear end thereof to the metal terminal 40 through a ceramic resistor 3 and conductive sealing members 4 in the axial hole 12 along the direction of the axis O. A high-voltage cable (not shown) is connected to the metal terminal 40 through a plug cap (not shown) so as to apply a high voltage to the metal terminal 40 during use of the spark plug 100.

Next, the metal shell 50 will be explained in detail below. The metal shell 50 is designed as a cylindrical fitting for fixing the spark plug 100 to the cylinder head of the internal combustion engine while surrounding a part of the ceramic insulator 10 from an end of the rear body portion 18 through the leg portion 13 to retain therein the ceramic insulator 10. The metal shell 50 is made of low-carbon steel and has a tool engagement portion 51 formed to engage with a spark plug wrench (not shown) and a mounting thread portion 52 formed with a thread to screw into a mounting hole of the engine cylinder head (not shown).

Further, the metal shell 50 has a flanged sealing portion 54 formed between the tool engagement portion 51 and the mounting thread portion 52. A thread neck 59 is provided between the mounting thread portion 52 and the sealing portion 54. An annular gasket 5, made by bending a plate material, is fitted on the thread neck 59. When the spark plug 100 is mounted in the mounting hole of the engine cylinder head (not shown), the gasket 5 is crushed and deformed between a bearing surface of the sealing portion 54 and an opening edge of the mounting hole to establish a seal therebetween for preventing engine gas leakage through the mounting hole.

The metal shell 50 also has a thin swaged portion 53 formed on a rear side of the tool engagement portion 51 and a thin buckling portion 58 formed between the tool engagement portion 51 and the sealing portion 54 in the same manner as the swaged portion 53. Annular ring members 6 and 7 are interposed between an outer circumferential surface of the rear body portion 18 of the ceramic insulator 10 and an inner circumferential surface of the tool engagement portion 51 and the swaged portion 53 of the metal shell 50. A talc powder (talc) 9 is filled between these ring members 6 and 7. The ceramic insulator 10 is pressed toward the front within the metal shell 50 via the ring members 6 and 7 and the talc 9 by swaging to bend the swaged portion 53 inwardly. The metal shell 50 and the ceramic insulator 10 are thus combined together, with the stepped portion 15 of the ceramic insulator 10 supported via an annular plate packing 8 on a stepped portion 56 of an inner circumferential surface of the metal shell 50 corresponding in position to the mounting thread portion 52. At this time, the gastightness between the metal shell 50 and the ceramic insulator 10 is kept by the plate packing 8 for prevention of combustion gas leakage. The buckling portion 58 is bent and deformed outwardly with the application of a compression force during the swaging so as to increase the compression length of the talc 9 along the direction of the axis O and to improve the gastightness of the metal shell 50.

The ground electrode 30 will be next explained in detail below. The ground electrode 30 is formed into a rectangular cross-section rod shape and made of nickel or nickel-based alloy such as Inconel 600 or 601 (trademark) as in the case of the center electrode 20. As shown in FIG. 2, one end portion (base end portion 32) of the ground electrode 30 is joined to the front end face 57 of the metal shell 50 and extended along the direction of the axis O, whereas the ground electrode 30 is bent to form a bent portion 34 such that a side surface (inner surface 33) of the other end portion (front end portion 31) of the ground electrode 30 faces the front end portion 22 of the center electrode 20.

The spark plug 100 further includes a spark section 80 disposed on the inner surface 33 of the front end portion 31 of the group electrode 30 at a position facing the front end portion 22 of the center electrode 20 and having a needle-like shape protruding toward the front end portion 22. The spark section 80 consists of an intermediate member 86 and a noble metal member 81 laminated and joined together in a protruding direction thereof from the ground electrode 30. The intermediate member 86 contains nickel as a main component and is formed into a cylindrical shape with a large-diameter flanged portion 87 at one axial end thereof (bottom side in FIG. 2). The noble metal member 81 contains a noble metal of high spark wear resistance as a main component and is joined to the other axial end (top side in FIG. 2) of the intermediate member 86. The intermediate member 86 and the noble metal member 81 are by laser welding or electron beam welding the vicinity of the mating faces between these members 86 and 81, thereby forming a fused joint 85 in which the constituent components of the intermediate member 86 and the noble metal member 81 are fused and mixed together. Further, the flanged portion 87 of the one end of the intermediate member 86 is joined by resistance welding to the inner surface 33 of the ground electrode 30 so that the noble metal member 81 faces the electrode tip 90 on the center electrode 20 to define a spark gap GAP between the noble metal member 81 and the electrode tip 90. It suffices that the spark section 80 faces the front end portion 22 of the center electrode 20 so as to define the spark gap GAP between these members. The opposing faces of the spark section 80 and the electrode tip 90 do not necessarily strictly correspond in position to each other. The center axis of the spark section 80 may thus not strictly agree with the axis O of the spark plug 100.

Figure 3:
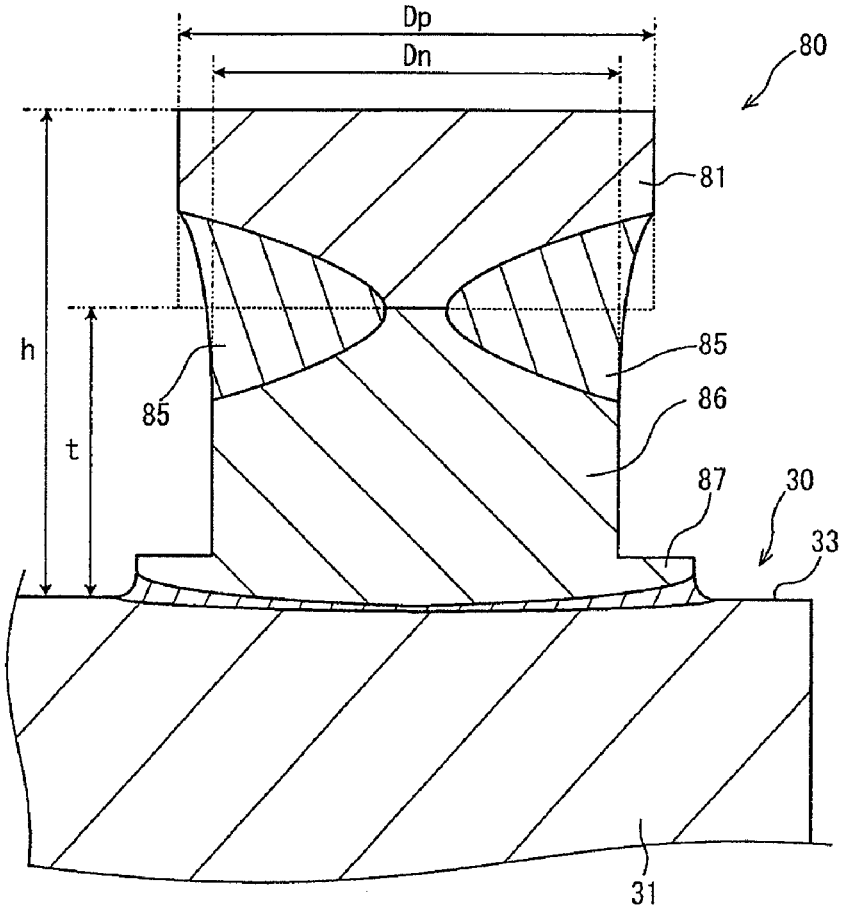
FIG. 3 is an enlarged section view of a spark section 80 according to the one embodiment of the present invention.

In the above-structured spark plug 100, the size of the spark section 80 is specified in such a manner that the spark section 80 has a needle-like shape protruding from the inner surface 33 of the ground electrode 30 as explained above. More specifically, the noble metal member 81 has an outer diameter Dp of 0.5 to 1.2 mm with the proviso that the outer diameter of the spark section 80 is defined with reference to the outer diameter Dp of the noble metal member 81 as shown in FIG. 3. Further, the spark section 80 has a length h of 0.6 to 1.6 mm in the protruding direction thereof from the inner surface 33 of the ground electrode 30 (hereinafter referred to as "protrusion length h"). The arrangement of such a needle-like shaped spark section 80 allows the ground electrode 60 to be located away from the spark gap GAP and reduces the quenching effect in which a flame core generated in the spark gap GAP loses heat in the initial stage of flame growth by contact with the ground electrode 30. It is thus possible to improve the ignition performance of the spark plug 100.

In the present embodiment, the noble metal member 81 and the intermediate member 88 are formed in such a manner that the thermal conductivity of the intermediate member 86 is lower than the thermal conductivity of the noble metal member 81 for further improvement in ignition performance. When the spark section 80 receives heat during operation of the engine (not shown), the heat is radiated from the spark section 80 and released to the metal shell 50 through the ground electrode 30. In the spark section 80, the heat is radiated from the noble metal member 81 through the intermediate member 86 to the ground electrode 30. As the thermal conductivity of the intermediate member 86 is set to be lower than the thermal conductivity of the noble metal member 81, the radiation of heat from the noble metal member 81 can be limited to allow heat accumulation in the noble metal member 81 and thereby maintain the noble metal member 81 at a higher temperature than conventional types by the occurrence of a spark discharge. The noble metal member 81 faces the spark gap GAP (as shown in FIG. 2) so that a flame core generated in the spark gap GAP comes into contact with the noble metal member 81, before the ground electrode 30, during the flame growth. As the temperature of the noble metal member 81 can be maintained higher than conventional types, the heat radiation from the flame core through the spark section 80 (i.e. the quenching effect of the spark section 80) can be reduced. It is thus possible to further improve the ignition performance of the spark plug 100.

When the heat radiation from the noble metal member 81 is too limited so that the noble metal member 81 reaches an excessively high temperature, it becomes likely that the noble metal member 81, which faces the spark gap GAP, will be consumed by oxidation. This can results in a deterioration of spark wear resistance. In the present embodiment, various structural conditions are set on the spark section 80 in order to effectively limit the heat radiation from the noble metal member 81 through the intermediate member 86 to the ground electrode 30.

First, the thermal conductivity of the intermediate member 86 is set to 10 to 25 W/(m·K). When the thermal conductivity of the intermediate member 86 is lower than 10 W/(m·K), the temperature of the noble metal member 81 can be increased for improvement in ignition performance. However, there is a possibility that the noble metal member 81 becomes susceptible to consumption by oxidation and causes a deterioration of spark wear resistance. When the thermal conductivity of the intermediate member 86 is higher than 25 W/(m·K), it becomes difficult to limit the heat radiation from the noble metal member 81 sufficiently and thus difficult to maintain the temperature of the noble metal member 81 higher than conventional types so that ignition performance improvement cannot be expected.

The length t of protrusion of the intermediate member 86 from the inner surface 33 of the ground electrode 30 (hereinafter referred to as "protrusion length t") is set to 0.2 to 1.4 mm. When the protrusion length t of the intermediate member 86 is smaller than 0.2 mm, the length of the heat radiation passage through the intermediate member 86 is short and is not sufficient to limit the heat radiation from the noble metal member 81. This makes it difficult to maintain the temperature of the noble metal member 81 higher than conventional types so that ignition performance improvement cannot be expected. When the protrusion length t of the intermediate member 86 is larger than 1.4 mm, the length of the heat radiation passage through the intermediate member 86 is so long that the heat radiation from the noble metal member 81 is too limited. This makes the noble metal member 81 more susceptible to consumption by oxidation, thereby resulting in a deterioration of spark wear resistant.

Further, the difference Dn−Dp between the outer diameter Dn of the intermediate member 86 and the outer diameter Dp of the noble metal member 81 is set to −0.1 to 0.5 mm. The difference Dn−Dp is given as a negative value when the outer diameter Dp of the noble metal member 81 located on the front side with respect to the protruding direction of the spark section 80 is larger than the outer diameter Dn of the intermediate member 86 located on the rear side with respect to the protruding direction of the spark section 80. When the difference Dn−Dp is smaller than −0.1 mm (i.e. the outer diameter Dp of the intermediate member 81 is larger than the outer diameter Dn of the intermediate member 86 by a difference exceeding 0.1 mm), the weight of the noble metal member 81 relative to the intermediate member 86 is increased so that the noble metal member 81 becomes more susceptible to vibration load during operation of the engine (not shown). This may cause fall-off of the noble metal member 81. When the difference Dn−Dp is larger than 0.5 mm (i.e. the outer diameter Dp of the noble metal member 81 is smaller than the outer diameter Dn of the intermediate member 86 by a difference exceeding 0.5 mm), the cross-sectional area of the intermediate member 86 located on the heat radiation passage from the noble metal member 81 to the ground electrode 30 is too large to limit the heat radiation from the noble metal member 81 sufficiently. This makes it difficult to maintain the temperature of the noble metal member 81 higher than conventional types so that ignition performance improvement cannot be expected.

As shown in FIG. 3, the outer diameter Dp of the noble metal member 81 and the outer diameter Dn of the intermediate member 86 refer to those before the joining of these members. It is desirable not to include the fused joint 85 in the outer diameter Dp of the noble metal member 81 and the outer diameter Dn of the intermediate member 86. The outer diameter Dn of the intermediate member 86 is determined with reference to a portion of the intermediate member 86 adjacent to the fused joint 85. There may be a case where the fused joint 85 is formed in the whole of the outer circumferential surface of the intermediate member 81 so as to continuous with the flanged portion 87 depending on the laser welding of the noble metal member 81 and the intermediate member 86 and the resistance welding of the intermediate member 86 and the ground electrode 30. Even in such a case, the portion of the intermediate member 86 adjacent to the fused joint 85 can be used as the reference to determine the outer diameter Dn of the intermediate member 86. More specifically, a portion of the intermediate member 86 located at the boundary between the fused joint 85 and the flanged portion 87 is specified as the portion of the intermediate member 86 adjacent to the fused joint 85.

The above effects of controlling the sizes and thermal conductivities of the noble metal member 81 and the intermediate member 86 in the spark section 80 of the spark plug 100 for improvement in ignition performance were verified by the following evaluation tests.

EXPERIMENT 1

First, an evaluation test was conducted to verify the relationship between the ignition performance and the thermal conductivity of the intermediate member of the spark section. For this evaluation test, eight kinds of materials (N40, N35, N30, N25, N20, N15, N10 and N5) containing Ni as a main component and having different thermal conductivities were prepared for production of intermediate members. The compositions of the respective materials are indicated in TABLE 1.

TABLE 1

| Material of intermediate | Composition of intermediate member [wt %] | | | | | | | Thermal conductivity |
|---|---|---|---|---|---|---|---|---|
| member | Ni | Si | Cr | Mn | Fe | Al | C | [W/(m · K)] |
| N40 | balance (97.88) | 0.7 | 0.2 | 0.2 | — | 1 | 0.02 | 40 |
| N35 | balance (96.18) | 1.2 | 0.2 | 0.2 | — | 2.2 | 0.02 | 35 |
| N30 | balance (94.68) | 1.5 | 1 | 0.3 | — | 2.5 | 0.02 | 30 |
| N25 | balance (94.98) | 1.5 | 1.5 | 2 | — | — | 0.02 | 25 |
| N20 | balance (90.98) | 1.5 | 2 | 2 | 3 | 0.5 | 0.02 | 20 |
| N15 | balance (75.48) | 0.2 | 16 | 0.3 | 8 | — | 0.02 | 15 |
| N10 | balance (62.48) | 0.1 | 25 | 0.1 | 10 | 2.3 | 0.02 | 10 |
| N5 | balance (52.48) | 2 | 30 | 2 | 10 | 3.5 | 0.02 | 5 |

As indicated in TABLE 1, the materials were prepared by mixing different contents of Si, Cr, Mn, Fe, Al and C (not using Fe and/or Al in some of the materials) and the balance of Ni and thereby containing Ni as the main component while showing different thermal conductivities. The thermal conductivities of the materials were 40, 35, 30, 25, 20, 15, 10 and 5 W/(m·K), respectively, in the order of the material number.

Eight types of intermediate members having an outer diameter Dn of 0.75 mm and a protrusion length t of 0.4 mm were formed using the above materials N40 to N5. Further, noble metal members having an outer diameter Dp of 0.7 mm and a protrusion length (h−t) of 0.5 mm were formed using a material of Pt-20Rh (thermal conductivity: 37.2 W/(m·K)). The intermediate members were joined to the noble metal members, respectively, thereby providing samples A11 to A18 of spark sections with a protrusion length h of 0.9 mm. Furthermore, a sample A19 (current product) of a spark section was formed with an outer diameter Dp of 0.7 mm and a protrusion length h of 0.9 mm using only a noble metal member of Pt-20Rh as a reference for evaluation.

Spark plugs for test uses (each having a metal shell with a nominal thread diameter of M14) were produced by resistance welding the samples A11 to A18 of the spark sections to the inner surfaces of front end portions of ground electrodes of the spark plugs, respectively, and by laser welding the sample A19 of the spark section to the inner surface of a front end portion of a ground electrode of the spark plug. The bending degree of a bent portion of each of the ground electrodes was adjusted to control the size of the spark gap GAP to 1.1 mm.

The spark plug with the sample A19 (current product) was mounted on a 2.0-liter, L4, 4-cylinder DOHC engine. The engine was driven under the conditions of 1400 rpm, NMEP, 100 kPa/4 cyl. and A/F: 15.5. While gradually retarding the ignition timing of the engine, the amount of retardation (° CA) of the ignition timing at which rotational variations (variations in rotation speed) exceeded 30% was measured and adopted as a reference. The same testing procedure was repeated on each of the spark plugs with the samples A11 to A18 to measure the retardation amount (° CA) of the ignition timing at which rotational variations exceeded 30%. The difference between each of the retardation amounts of the samples A11 to A18 and the reference retardation amount of the sample 19 (current product) (hereinafter referred to as "retardation difference") was determined. The timing difference was given as a positive value when the ignition timing was more retarded than that of the sample A19 and as a negative value when the ignition timing was more advanced than that of the sample A19. The test results are indicated in TABLE 2.

TABLE 2

| Sample | Material of intermediate member | Thermal conductivity [W/(m · K)] Noble metal member | Intermediate member | Timing difference [° CA] | Ignition performance |
|---|---|---|---|---|---|
| A11 | N40 | 37.2 | 40 | −1 | X |
| A12 | N35 | (Pt—20Rh) | 35 | 0.3 | ○ |
| A13 | N30 | | 30 | 0.6 | ○ |
| A14 | N25 | | 25 | 1 | ◎ |
| A15 | N20 | | 20 | 1.3 | ◎ |
| A16 | N15 | | 15 | 1.5 | ◎ |
| A17 | N10 | | 10 | 1.8 | ◎ |
| A18 | N5 | | 5 | 2.5 | ◎ |
| A19 (current product) | none | | (37.2) | 0 | — |

As shown in TABLE 2, the sample A11 was formed using N40 as the material of the intermediate member so that the thermal conductivity of the intermediate member was higher than that of the noble metal member. The heat radiation from the noble metal member in the sample A11 was more favorable than that in the current product sample. The sample A11 had a timing difference of −1° A relative to the sample A19 as in the result of the evaluation test. The ignition performance of the sample A11 was thus rated as "Deteriorated" (marked with the symbol "X"). The samples A12 and A13, in which N35 and N30 were as the materials of the intermediate members so that the thermal conductivity of the intermediate member was lower than that of the noble metal member, had a timing difference of 0.3° A and a timing difference of 0.6° A relative to the sample A19, respectively. Although the heat radiation from the noble metal member was limited to obtain an improvement in ignition performance in each of the samples A12 and A13 relative to the current product sample, the timing differences of these samples were merely on the order of less than 1° A. The ignition performance of the samples A12 and A13 was thus rated as "Good" (marked with the symbol "○").

The samples A14, A15, A16, A17 and A18, in which N25, N20, N15, N10 and N15 were used as the materials of the intermediate members, had timing differences of 1, 1.3, 1.5, 1.8 and 2.5° A relative to the sample A19, respectively. In each of the samples A14 to A18, the thermal conductivity of the intermediate member was lower than that of the noble metal member. Further, the difference in thermal conductivity between the intermediate member and the noble metal member was larger in the samples A14 to A18 than in the samples A12 and A13. The heat radiation from the noble metal member was more limited in the samples A14 to A18 than in the samples A12 and A13. As a result, the timing differences of these samples became larger than or equal to 1° CA. The ignition performance of the samples A14 to A18 was improved relative to the current product sample and rated as "Excellent" (marked with the symbol "◎"). By these results, it has been shown that it is possible to improve the ignition performance effectively by setting the thermal conductivity of the intermediate member to be lower than that of the noble metal member and be 35 W/(m·K) or lower and possible to improve the ignition performance more favorably by setting the thermal conductivity of the intermediate member to be 25 W/(m·K) or lower.

EXPERIMENT 2

The same verification test was also conducted on the case of the noble metal member having a different thermal conductivity from that of Experiment 1. For this test, eight types of samples A21 to A28 of spark sections were produced by forming the same eight types of intermediate members as above from the above materials N40 to N5, forming noble metal members from Pt-10Ni (thermal conductivity: 27.8 W/(m·K)) and joining the noble metal members to the intermediate members, respectively. The sizes of the noble metal members and the intermediate members were the same as above. Further, a sample A29 (current product) of a spark section was formed as a reference for evaluation in the same manner as above using only a noble metal member of Pt-10Ni. The samples of A21 to A29 were attached to spark plugs for test uses. The same evaluation test procedure was conducted on each of the samples A21 to A29. The test results are indicated in TABLE 3.

TABLE 3

| Sample | Material of intermediate member | Thermal conductivity [W/(m · K)] Noble metal member | Thermal conductivity [W/(m · K)] Intermediate member | Timing difference [° CA] | Ignition performance |
|---|---|---|---|---|---|
| A21 | N40 | 27.8 | 40 | −1.4 | X |
| A22 | N35 | (Pt—10Ni) | 35 | −1 | X |
| A23 | N30 | | 30 | −0.3 | X |
| A24 | N25 | | 25 | 0.3 | ○ |
| A25 | N20 | | 20 | 0.8 | ○ |
| A26 | N15 | | 15 | 1.2 | ◎ |
| A27 | N10 | | 10 | 1.5 | ◎ |
| A28 | N5 | | 5 | 2.2 | ◎ |
| A29 (current product) | none | | (27.8) | 0 | — |

As shown in TABLE 3, each of the samples A21, A22 and A23, in which N40, N35 and N30 were used as the materials of the intermediate members so that the thermal conductivity of the intermediate member was higher than that of the noble metal member, had a negative timing difference relative to the sample A29. The heat radiation from the noble metal member in the samples A21, A22 and A23 was more favorable than that in the current product sample. The ignition performance of these samples was thus rated as "Deteriorated" (marked with the symbol "X"). On the other hand, each of the samples A24 to A28, in which N25, N20, N15, N10 and N5 were used as the materials of the intermediate members so that the thermal conductivity of the intermediate member was lower than that of the noble metal member, had a positive timing difference relative to the sample A29. The heat radiation from the noble metal member was limited to show an ignition performance improvement in the samples A24 to A28 relative to the current product sample. In particular, the samples A26 to A28 had a timing difference of 1° CA or larger. The ignition performance of the samples A26 to A28 was thus rated as "Excellent"and marked with the symbol "◎". The ignition performance of the samples A24 and 25 was rated as "Good" and marked with the symbol "○" as the timing differences of the samples A24 and 25 were on the order of smaller than 1° CA.

It has been shown by these results that, even in the case of the noble metal member being of the lower thermal conductivity material, the ignition performance can be improved sufficiently effectively by setting the thermal conductivity of the intermediate member to be lower than the thermal conductivity of the noble metal member. In consideration of the results of Experiment 1, it has been confirmed that it is possible to obtain at least the ignition performance improvement effect by setting the thermal conductivity of the intermediate member to be 25 W/(m·K) or lower even though the thermal conductivity of the noble metal member varies with the kind of the material of the noble metal member.

EXPERIMENT 3

Next, an evaluation test was conducted to verify the relationship between the spark wear resistance and the thermal conductivity of the intermediate member of the spark section. For this evaluation test, spark plugs having the same samples A21 to A29 as those of Experiment 2 were produced. Each of the spark plugs with the samples A21 to A29 was mounted on a 2.0-liter, 4-cylinder gasoline engine and tested by driving the engine under the conditions of 5000 rpm and WOT (full throttle) for 400 hours according to bench durability test procedure. The size of the spark gap GAP of each sample was measured after the durability test. Then, the difference between the initial size (1.1 mm) and the measured size of the spark gap GAP (i.e. the amount of consumption of the noble metal member by spark discharges) was determined. The test results are indicated in TABLE 4.

TABLE 4

| Sample | Material of intermediate member | Thermal conductivity [W/(m · K)] Noble metal member | Thermal conductivity [W/(m · K)] Intermediate member | Consumption of noble metal member [mm] | Spark wear resistance |
|---|---|---|---|---|---|
| A21 | N40 | 27.8 | 40 | 0.03 | ◎ |
| A22 | N35 | (Pt—10Ni) | 35 | 0.03 | ◎ |
| A23 | N30 | | 30 | 0.03 | ◎ |
| A24 | N25 | | 25 | 0.04 | ○ |
| A25 | N20 | | 20 | 0.05 | ○ |
| A26 | N15 | | 15 | 0.05 | ○ |
| A27 | N10 | | 10 | 0.07 | ○ |
| A28 | N5 | | 5 | 0.15 | X |
| A29 (current product) | none | | none (27.8) | 0.03 | — |

As shown in TABLE 4, the samples A21 to A23, in each of which the thermal conductivity of the intermediate member was higher than that of the noble metal member so that the heat radiation from the noble metal member was more favorable than that in the sample A29 (current product), had the same noble metal member consumption amounts (0.03 mm) as that of the sample A29. The spark wear resistance of the samples A21 to A23 was thus rated as "Excellent" (marked with the symbol "◎"). On the other hand, the samples A24 to 29 showed a tendency that the size of the spark gap GAP increased with decrease in the thermal conductivity of the intermediate member. In particular, the noble metal member consumption amount exceeded 0.1 mm in the sample A28 where the thermal conductivity of the intermediate member was lower than 10 W/(m·K). The noble metal member was much more consumed in the sample A28 than in the sample A29. The spark wear resistance of the sample A28 was thus rated as "Not good" (marked with the symbol "X"). Although the size of the spark gap GAP was more increased in each of the samples A24 to A27 than in the sample A29, the increase in spark gap size was 0.1 mm or smaller. The spark wear resistance of the samples A24 to A27 was thus rated as "Acceptable" and marked with the symbol "○". It has been shown by the these test results that the spark wear resistance can be maintained in an acceptable range, even if deteriorated, by setting the thermal conductivity of the intermediate member to be 10 W/(m·K) or higher. In consideration of the results of Experiments 1 and 2, it has been confirmed that it is rather preferable to set the thermal conductivity of the intermediate member to be 10 W/(m·K) or higher for improvement in ignition performance.

EXPERIMENT 4

Next, an evaluation test was conducted to verify the relationship between the ignition performance and the protrusion length t of the intermediate member of the spark section. For this evaluation test, five types of intermediate members having an outer diameter Dn of 0.75 mm and a protrusion length t varying from 0.1 to 1.4 mm were formed using the material N15 (thermal conductivity 15 W/(m·K)) indicated in TABLE 1. Noble metal members were formed from Pt-10Ni (thermal conductivity: 27.8 W/(m·K)), each of which had an outer diameter Dp of 0.7 mm and a protrusion length (h−t) varying according to the protrusion length of the intermediate member in such a manner as to provide a spark section with a protrusion length h of 1.6 mm. The intermediate members and the noble metal members were joined together, thereby providing five types of samples A31 to A35 of spark sections. These samples were attached to the same spark plugs for test uses as those of Experiment 1. The size of the spark gap GAP of each of the samples was controlled to 1.1 mm. Further, a sample A39 (current product) of a spark section having an outer diameter Dp of 0.7 mm and a protrusion length h of 1.6 mm was formed as a reference for evaluation using only a noble metal member of Pt-10Ni and attached to a spark plug for test use in the same manner as above. Each of the spark plugs with the samples A31 to A35 and A39 was tested for ignition performance according to the same procedure and under the same conditions as in Experiment 1. The test results are indicated in TABLE 5.

TABLE 5

| Sample | Protrusion length of noble metal member h [mm] | Protrusion length of intermediate member t [mm] | Timing difference [° CA] | Ignition performance |
|---|---|---|---|---|
| A31 | 1.6 | 0.1 | 0.1 | Δ |
| A32 | | 0.2 | 0.3 | ○ |
| A33 | | 0.5 | 1.1 | ◎ |
| A34 | | 1 | 1.4 | ◎ |
| A35 | | 1.4 | 1.6 | ◎ |
| A39 (current product) | | none (0) | 0 | — |

As shown in TABLE 5, the sample A31, in which the thermal conductivity of the intermediate member was lower than that of the noble metal member, had a timing difference of 0.1 that was not so large relative to the sample A39. In the sample A31, the intermediate member between the noble metal member and the ground electrode member had a small protrusion length t of 0.1 mm so that the heat radiation passage through the intermediate member was short in length. It could hardly be said that the heat radiation from the noble metal member was limited effectively in this sample although it was limited to some extent. It was thus difficult to maintain the temperature of the noble metal member higher than the conventional type. The ignition performance was rated as "Almost no improvement expected" (marked with the symbol "Δ"). In the samples A32 to A35, the length of the heat radiation passage through the intermediate member increased with the protrusion length t so as to provide higher resistance to heat transfer and to promote heat accumulation in the noble metal member. As a result, these samples had a tendency that the timing difference increased. The ignition performance of the sample A32, of which the timing difference was smaller than 1° CA, was rated as "Good" and marked with the symbol "○". Each of the samples A33 to A35 had a timing difference of 1° CA or larger and obtained a further improvement in ignition performance relative to the current product sample as the heat radiation from the noble metal member was more limited in these samples. The ignition performance of the samples A33 to A35 was thus rated as "Excellent" (marked with the symbol "◎"). It has been shown by these test results that it is possible to limit the heat radiation from the noble metal member and improve the ignition performance adequately by setting the protrusion length t of the intermediate member to be 0.2 mm or larger.

EXPERIMENT 5

An evaluation test was further conducted to verify the relationship between the spark wear resistance and the protrusion length t of the intermediate member of the spark section. For this evaluation test, the same samples A31 to A35 and A39 of spark sections as those of Experiment 4 were produced. In addition, a sample A36 of a spark section was produced in the same manner as in Experiment 4 by forming an intermediate member with a protrusion length t of 1.5 mm, forming a noble metal member corresponding to the intermediate member and joining the intermediate member and the noble metal member together. These samples were attached to spark plugs for test uses, respectively. Each of the spark plugs with the samples was mounted on a test engine and subjected to durability test by simulation driving under the conditions of WOT (full throttle) for 400 hours in the same manner as in Experiment 3. The size of the spark gap GAP of each sample was measured after the durability test. Then, the difference between the initial size (1.1 mm) and the measured size of the spark gap GAP (i.e. the amount of consumption of the noble metal member by spark discharges) was determined. The test results are indicated in TABLE 6.

TABLE 6

| Sample | Protrusion length of noble metal member h [mm] | Protrusion length of intermediate member t [mm] | Consumption of noble metal member [mm] | Spark wear resistance |
|---|---|---|---|---|
| A31 | 1.6 | 0.1 | 0.05 | ◎ |
| A32 | | 0.2 | 0.06 | ○ |
| A33 | | 0.5 | 0.06 | ○ |
| A34 | | 1 | 0.07 | ○ |
| A35 | | 1.4 | 0.09 | ○ |
| A36 | | 1.5 | 0.12 | X |
| A39 (current product) | | none (0) | 0.05 | — |

As shown in TABLE 6, in the sample A31 where the thermal conductivity of the intermediate member was lower than that of the noble metal member, the intermediate member had a small protrusion length t of 0.1 mm such that the length of the heat radiation passage through the intermediate member was small so as to provide lower resistance to heat transfer and allow efficient heat radiation from the noble metal member. The consumption of the noble metal member by oxidation was thus limited for improvement in spark wear resistance. The consumption amount of the noble metal member in the sample A31 was kept at the same level (0.05 mm) as that in the sample A39 with no intermediate member. (The spark wear resistance of this sample was rated as "Excellent"and marked with the symbol "◎".) In the samples A32 to A35 where the protrusion length t of the intermediate member was 0.2 to 1.4 mm, the consumption amount of the noble metal member was larger than that in the sample A39 but less than 0.1 mm. The spark wear resistance of these samples was rated as "Acceptable" and marked with the symbol "○". In the sample A36 where the protrusion length t was 1.5 mm, by contrast, the heat radiation passage through the intermediate member was too long so as to thereby provide high resistance to heat transfer and promote heat accumulation in the noble metal member. It was thus difficult limit the consumption of the noble metal member by oxidation. The spark wear resistance of this sample was rated as "Lowered" and marked with the symbol "X". It has been shown by the above evaluation test results that the spark wear resistance can be maintained in an acceptable range, even if deteriorated relative to conventional spark sections, by setting the protrusion length t of the intermediate member to be 1.5 mm or smaller. In consideration of the results of Experiment 4, it has been confirmed that it is rather preferable to set the protrusion length t of the intermediate member to be 1.5 mm or smaller for improvement in ignition performance.

EXPERIMENT 6

Next, an evaluation test was conducted to verify the relationship between the durability and the difference Dn−Dp between the outer diameter Dp and Dn of the intermediate member and the noble metal member of the spark section. For this evaluation test, noble metal members having an outer diameter Dp of 0.7 mm and a protrusion length (h−t) of 0.5 mm were formed using a material of Pt-10Rh (thermal conductivity 27.8 W/(m·K)). Further, five types of intermediate members having an outer diameters Dn varying from 0.5 to 1.3 mm and a protrusion length t of 0.4 mm were formed using the material N15 (thermal conductivity 15 W/(m·K)) indicated in TABLE 1. The intermediate members and the noble metal members were joined together by laser welding, thereby providing samples A41 to A45 of spark sections with a protrusion length h of 0.9 mm and an outer diameter difference Dn−Dp varying from −0.2 to 0.6 mm. Furthermore, a sample A49 (current product) of a spark section was formed as a reference for evaluation with an outer diameter of 0.7 mm and a protrusion length h of 0.9 mm using only a noble metal member of Pt-10Ni.

The samples A41 to A49 were attached to spark plugs for test uses, respectively. Each of the spark plugs was mounted on a 2.0-liter, 4-cylinder gasoline engine and subjected to heat and vibration loads by 1000 cycles of no-load racing pattern. The no-load racing pattern is a test pattern for shifting the engine from an idling state to a full throttle state (7000 rpm) in a stroke and returning the engine to an idling state and is particularly suitable for evaluation of the influence of vibration loads on the sample. The test results are indicated in TABLE 7.

TABLE 7

| Sample | Outer diameter of noble metal member Dp [mm] | Outer diameter of intermediate member Dn [mm] | Outer diameter difference Dn − Dp [mm] | Fall-off of noble metal member |
|---|---|---|---|---|
| A41 | ϕ 0.7 | ϕ 0.5 | −0.2 | occurred |
| A42 | | ϕ 0.6 | −0.1 | not occured |
| A43 | | ϕ 0.7 | 0 | not occured |
| A44 | | ϕ 1.0 | 0.3 | not occured |
| A45 | | ϕ 1.2 | 0.5 | not occured |
| A46 | | ϕ 1.3 | 0.6 | not occured |

In the sample 41 where the difference Dn−Dp was −0.2 mm, the noble metal member fell off with the occurrence of a separation at the joint interface between the intermediate member and the noble metal member as shown in TABLE 7. In the sample A41, the outer diameter Dn of the intermediate member was 0.5 mm; whereas the outer diameter Dp of the noble metal member was 0.7 mm and was 0.2 mm larger than the outer diameter Dn of the intermediate member. The noble metal member was more susceptible to vibration loads as the weight of the noble metal member relative to the intermediate member was increased. In the samples A42 to A46 where the difference Dn−Dp was larger than −0.2 mm, by contrast, the fall-off of the noble metal member did not occur. It has been confirmed from these results that it is preferable to set the difference Dn−Dp to be larger than or equal to −0.1 mm.

EXPERIMENT 7

Furthermore, an evaluation test was conducted to verify the relationship between the ignition performance and the difference Dn−Dp. For this evaluation test, spark plugs for test uses were produced in the same manner as in Experiment 1 using the same samples A41 to A46 as those of Experiment 6. Further, the same sample A29 (current product) of the spark section as that of Experiment 3 was formed with an outer diameter Dp of 0.7 mm and a protrusion length h of 0.9 mm using only a noble metal member of Pt-10Ni and then attached to a spark plug for test use in the same manner as above. Each of the spark plugs with the samples A41 to A46 and A29 was tested for ignition performance according to the same procedure and under the same conditions as in Experiment 1. The test results are indicated in TABLE 8.

TABLE 8

| Sample | Outer diameter of noble metal member Dp [mm] | Outer diameter of intermediate member Dn [mm] | Outer diameter difference Dn − Dp [mm] | Timing difference | Ignition performance |
|---|---|---|---|---|---|
| A41 | ϕ 0.7 | ϕ 0.5 | −0.2 | 1.9 | ◎ |
| A42 | | ϕ 0.6 | −0.1 | 1.5 | ◎ |
| A43 | | ϕ 0.7 | 0 | 1.3 | ◎ |
| A44 | | ϕ 1.0 | 0.3 | 0.9 | ○ |
| A45 | | ϕ 1.2 | 0.5 | 0.3 | ○ |
| A46 | | ϕ 1.3 | 0.6 | 0.1 | Δ |
| A29 (current product) | | none | (0) | 0 | — |

As shown in TABLE 8, the sample A46, in which the thermal conductivity of the intermediate member was lower than that of the noble metal member, had a timing difference of 0.1 that was not so large relative to the sample A29 (current product). In the sample A46, the outer diameter difference Dn−Dp between the intermediate member and the noble metal member was 0.6 mm so that there occurred a smooth heat transfer due to a large cross-sectional area of the heat radiation passage through the intermediate member. It could hardly be said that the heat radiation from the noble metal member was limited effectively although it was limited to some extent. It was thus difficult to maintain the temperature of the noble metal member higher than the conventional type. The ignition performance of this sample was rated as "Almost no improvement expected" (marked with the symbol "Δ"). On the other hand, each of the samples A41 to A45, in which the difference Dn−Dp in outer diameter between the intermediate member and the noble metal member was 0.5 mm or smaller, had a positive timing difference. In these samples, the heat transfer, i.e., heat radiation from the noble metal member was limited to promote heat accumulation in the noble metal member. As a result, the timing difference increased. The ignition performance of the samples A44 and A45, of which the timing difference was smaller than 1° CA, was rated as "Good" and marked with the symbol "○". Each of the samples A41 to A43 had a timing difference of 1° CA or larger and obtained a further improvement in ignition performance relative to the current product sample as the heat radiation from the noble metal member was more limited in these samples. The ignition performance of the samples A41 to A43 was thus rated as "Excellent" (marked with the symbol "◎"). By these evaluation test results, it has been shown that it is possible to limit the heat radiation from the noble metal member and improve the ignition performance more effectively by setting the outer diameter difference Dn−Dp between the intermediate member and the noble metal member to be 0.5 mm or smaller.

EXPERIMENT 8

Figure 6:
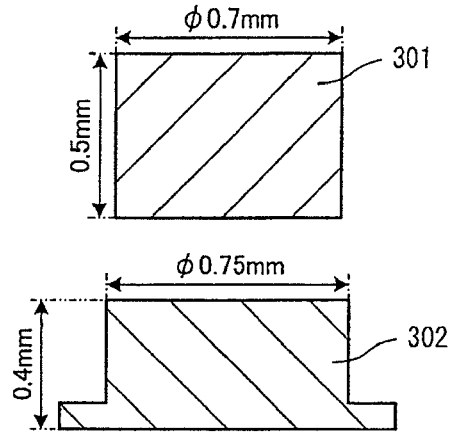
FIG. 6 is a schematic view showing the shapes of a noble metal member 301 and an intermediate member 302 before assembled into a spark section 300 (see FIG. 7) of Sample No. A26 of Experiment 8.
Figure 8:
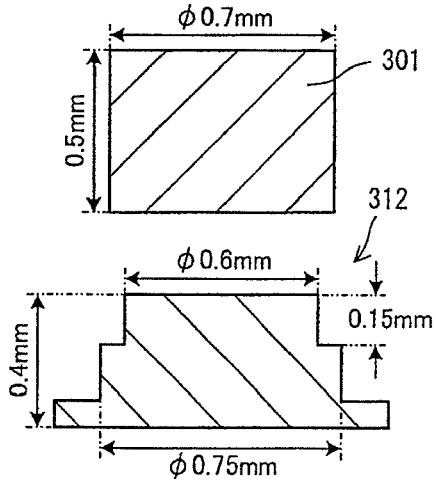
FIG. 8 is a schematic view showing the shapes of a noble metal member 301 and an intermediate member 312 before assembled into a spark section 310 (see FIG. 9) of Sample No. A51 of Experiment 8.
Figure 9:
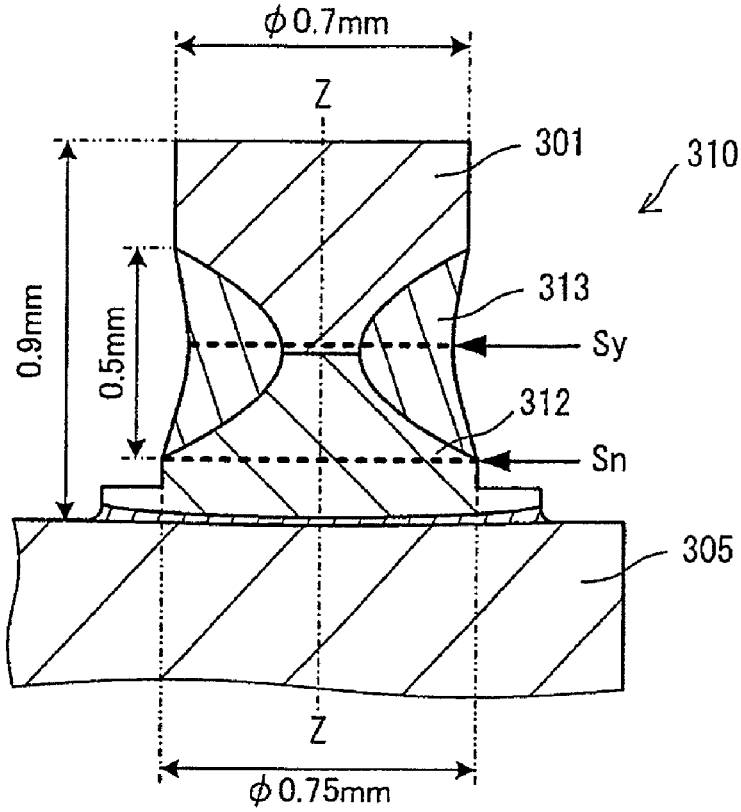
FIG. 9 is a schematic view showing the outer profile of a fused joint 313 formed in the spark section 310 of Sample No. A51 of Experiment 8.
Figure 10:
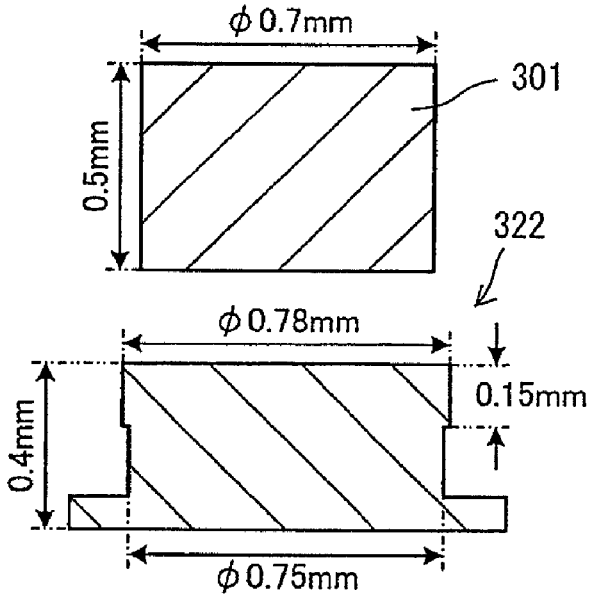
FIG. 10 is a schematic view showing the shapes of a noble metal member 301 and an intermediate member 322 before assembled into a spark section 320 (see FIG. 11) of Sample No. A52 of Experiment 8.
Figure 12:
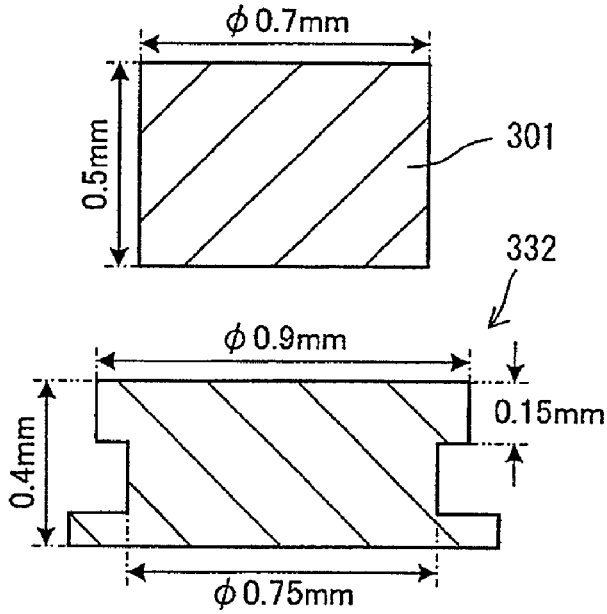
FIG. 12 is a schematic view showing the shapes of a noble metal member 301 and an intermediate member 332 before assembled into a spark section 330 (see FIG. 13) of Sample No. A53 of Experiment 8.

An evaluation test was next conducted to verify the relationship between the ignition performance and the outer profile of the fused joint. For this evaluation test, the same test sample A26 as that of Experiment 2 and three other test samples A51, A52 and A53 each having a size and composition based on those of the sample A26 but a fused joint of different outer profile from that of the sample A26 were formed. The same sample A29 (current product; see TABLE 3) as that of Experiment 2 was also formed for comparison purpose. More specifically, the same noble metal members 301 were formed of a material Pt-10Ni (thermal conductivity 27.8 W/(m·K)) with an outer diameter ϕ of 0.75 mm and a height (length) of 0.5 mm as shown in FIG. 6 for preparation of the respective samples. An intermediate member 302 of the sample A26 was formed of a material N15 (see TABLE 1) with an outer diameter ϕ of 0.75 mm and a height (length) of 0.4 mm and provided with a flanged end for joint to a ground electrode 305 (see FIG. 9). As shown in FIG. 8, an intermediate member 312 of the sample A51 was formed in the same manner as the intermediate member 302, except that the diameter of an end portion of the intermediate member 312 extending 0.15 mm from a joint to the noble metal member 301 was decreased to ϕ 0.6 mm. An intermediate member 322 of the sample A52 was formed in the same manner as the intermediate member 302, except that the diameter of an end portion of the intermediate member 322 extending 0.15 mm from a joint to the noble metal member 301 was increased to ϕ 0.78 mm as shown in FIG. 10. An intermediate member 332 of the sample A53 was formed in the same manner as the intermediate member 302, except that the diameter of an end portion of the intermediate member 332 extending 0.15 mm from a joint to the noble metal member 301 was increased to ϕ 0.9 mm as shown in FIG. 12.

Figure 7:
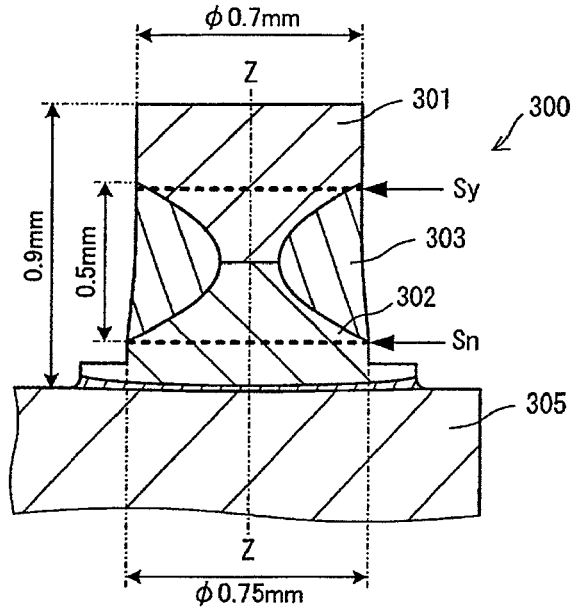
FIG. 7 is a schematic view showing the outer profile of a fused joint 303 formed in the spark section 300 of Sample No. A26 of Experiment 8.
Figure 11:
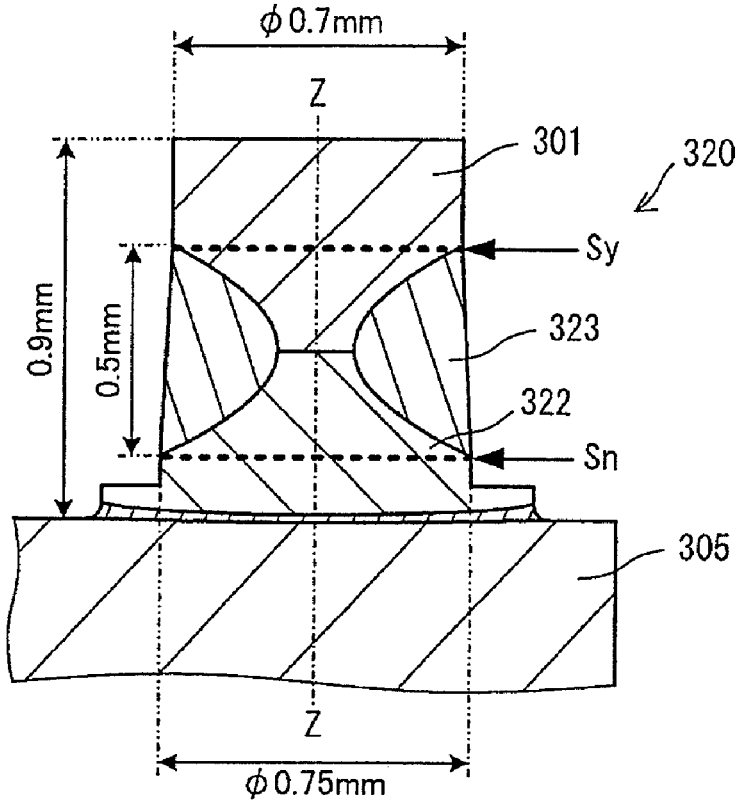
FIG. 11 is a schematic view showing the outer profile of a fused joint 323 formed in the spark section 320 of Sample No. A52 of Experiment 8.
Figure 13:
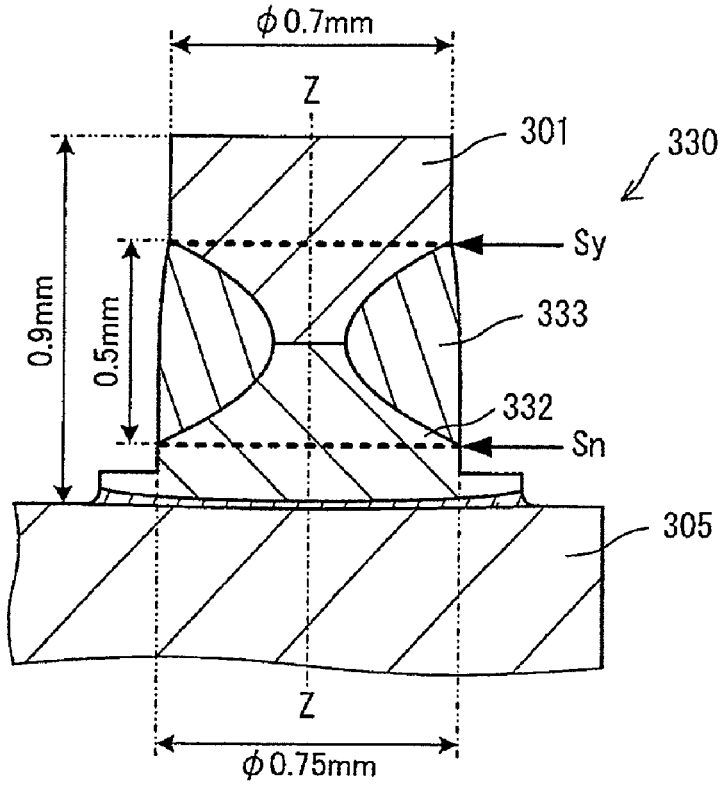
FIG. 13 is a schematic view showing the outer profile of a fused joint formed in the spark section 330 of Sample No. A53 of Experiment 8.

The noble metal members 301 were joined by laser welding to the intermediate members 302, 312, 322 and 332, respectively. Herein, the welding conditions varied from sample to sample so as to achieve the optimum joint state for each sample. As shown in FIG. 7, the outer profile of a fused joint 303 formed in the spark section 300 of the sample A26 (i.e. the contour of the cross section of the fused joint 303 of the spark section 300) was of arc shape concave inwardly toward the center axis Z of the spark section 300. As shown in FIG. 9, the outer profile of a fused joint 313 formed in the spark section 310 of the sample A51 was of arc shape more concave inwardly toward the center axis Z of the spark section 310 than that of the fused joint 303 of the sample A26. The outer profile of a fused joint 323 formed the spark section 320 of the sample A52 was of linear shape as shown in FIG. 11. Further, the outer profile of a fused joint 333 formed in the spark section 330 of the sample A53 was of arc shape convex outwardly from the center axis Z of the spark section 330 as shown in FIG. 13.

These samples A26, A51, A52, A53 and A29 were joined to ground electrodes 305 of spark plugs for test uses, respectively. Each of the spark plugs with the samples A26, A51, A52, A53 and A29 was tested and evaluated in the same manner as in Experiment 1. The test results are indicated in TABLE 9.

TABLE 9

| Sample | Outer profile of fused joint | Timing difference | Ignition performance |
|---|---|---|---|
| A26 | inwardly concave arc shape | 1.2 | ◎ |
| A51 | inwardly concave arc shape | 1.6 | ◎ |
| A52 | linear shape | 1.0 | ◎ |
| A53 | outwardly convex shape | 0.9 | ○ |
| A29 (current product) | no intermediate member | 0 | — |

As shown in TABLE 9, the samples A26 and A51, in each of which the contour of the fused joint in the cross section of the spark section (the outer profile of the fused joint) was of arc shape concave (inwardly) toward the center axis Z, had timing differences of 1.2 and 1.6° CA relative to the current product (sample A29) with no intermediate member. The ignition performance of the samples A26 and A51 was rated as "Good" and marked with the symbol "◎" as each of these samples secured a timing difference of 1° CA or larger. The sample A52, in which the outer profile of the fused joint was of linear shape, also secured a timing difference of 1° CA or larger relative to the sample A29. The ignition performance of the sample A52 was thus rated as "Good" and marked with the symbol "◎". On the other hand, the sample A53, in which the outer profile of the joint was of arc shape convex (outwardly) from the center axis Z, had a timing difference of 0.7° CA. The timing difference of the sample A53 was smaller than 1° CA but was given as a positive value. The ignition performance of the sample A53 was thus rated as "Good" and marked with the symbol "○". It has been shown by these test results that it is possible to limit the heat radiation and improve the ignition performance by forming the outer profile of fused joint between the noble metal member and the intermediate member into a linear shape or inwardly concave arc shape.

EXPERIMENT 9

An evaluation test was conducted to verify the relationship of the spark wear resistance of the noble metal member and the ratio Sy/Sn between the minimum cross-sectional area Sy of the spark section taken through the fused joint and the cross-sectional area Sn of the spark section taken through only the intermediate member at a position closest to the fused joint. For this evaluation test, the same samples A26 and A51 of the spark sections as those of Experiment 8 each having a fused joint formed with an outer profile of inwardly concave arc shape and a sample A51 of a spark section having a fused joint formed with an outer profile of arc shape more concave inwardly than that of the sample A51 were formed. (The size and composition of the sample A51 were based on those of the sample A26 as in the case of Experiment 8.) X-ray images of the spark sections of the samples A26, A51 and A55 were taken. Then, the cross-sectional areas Sy and Sn of the samples A26, A51 and A55 were determined from these images. The cross-sectional areas Sy of the samples A26, A51 and A55 were 0.38, 0.24 and 0.20 $mm^2$, respectively. The cross-sectional areas Sn of the samples A26, A51 and A55 were 0.44 $mm^2$. By way of examples, dotted lines in FIGS. 7, 9, 11 and 13 where the spark sections 300, 310, 320 and 330 of Experiment 8 are shown in cross section indicates the measurement positions of the cross-sectional areas Sy and Sn of the spark sections.

The ratios Sy/Sn of the samples A26, A51 and A55 were 0.86, 0.55 and 0.45, respectively. It was thus confirmed that the degree of narrowing of the fused joint (i.e. the concave degree of the inward concave arc outer profile of the fused joint) increased in the order of the samples A26, A51 and A55. The samples A26, A51 and A55 were attached to spark plugs for test uses. Each of the spark plugs with the samples A26, A51 and A55 was tested and evaluated in the same manner as in Experiment 3. The test results are indicated in TABLE 10.

TABLE 10

| Sample | Sy [$mm^2$] | Sn [$mm^2$] | Sy/Sn | Consumption of noble metal member [mm] | Spark wear resistance |
|---|---|---|---|---|---|
| A26 | 0.38 | 0.44 | 0.86 | 0.05 | ○ |
| A51 | 0.24 | | 0.55 | 0.08 | ○ |
| A55 | 0.20 | | 0.45 | 0.12 | X |

As shown in TABLE 10, the consumption amount of the noble metal member was 0.05 mm in the sample A26 and 0.08 mm in the sample A51. The consumption amount of the noble metal member in each of these samples was more than that (0.03 mm) in the sample A29 of Experiment 3 but less than or equal to 0.1 mm. The spark wear resistance of the samples A26 and A51 was thus rated as "Acceptable" and marked with the symbol "○". In the sample A55, on the other hand, the consumption amount of the noble metal member was 0.12 mm and exceeded 0.1 mm. The noble metal member was much more consumed in the sample A55 than in the sample A29. The spark wear resistance of this sample was thus rated as "Not good" and marked with the symbol "X". It has been shown by these test results that the spark wear resistance of the spark section can be maintained in an acceptable range, even if deteriorated relative to conventional spark sections, by setting the ratio Sy/Sn to be 0.55 or greater. In consideration of the results of Experiment 8, it has been confirmed that it is rather preferable to set the ratio Sy/Sn to be 0.55 or greater for improvement in ignition performance.

Figure 4:
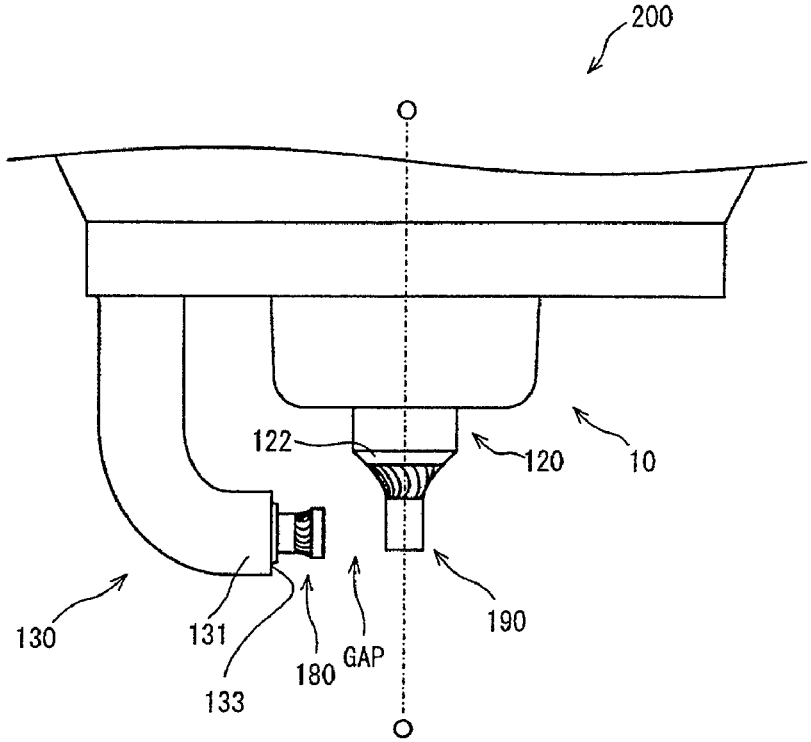
FIG. 4 is an enlarged section view of the vicinity of a spark gap GAP of a spark plug 200 according to a modified embodiment of the present invention.

Needless to say, various modifications of the above embodiments of the present invention are possible. Although the spark section 80 was joined to the inner surface 33 of the end portion 31 of the ground electrode 30, the inner surface 33 refers to one side surface of the ground electrode 30 facing the front end portion 22 of the center electrode 20 and does not necessarily refer to an inwardly directed surface of the bent portion of the ground electrode 300. For example, in the case of a spark plug 20 with an electrode tip 190 joined to a front end portion 122 of a center electrode 120 and extending along the axis O and with a spark section 180 disposed on a front end portion 131 of a ground electrode 130 to define a spark gap GAP between the electrode tip 190 and the spark section 180 as shown in FIG. 4, an inner surface 130 of the ground electrode 130 refers to any surface facing the spark gap GAP and directed toward the front end portion 122 of the center electrode 120.

Figure 5:
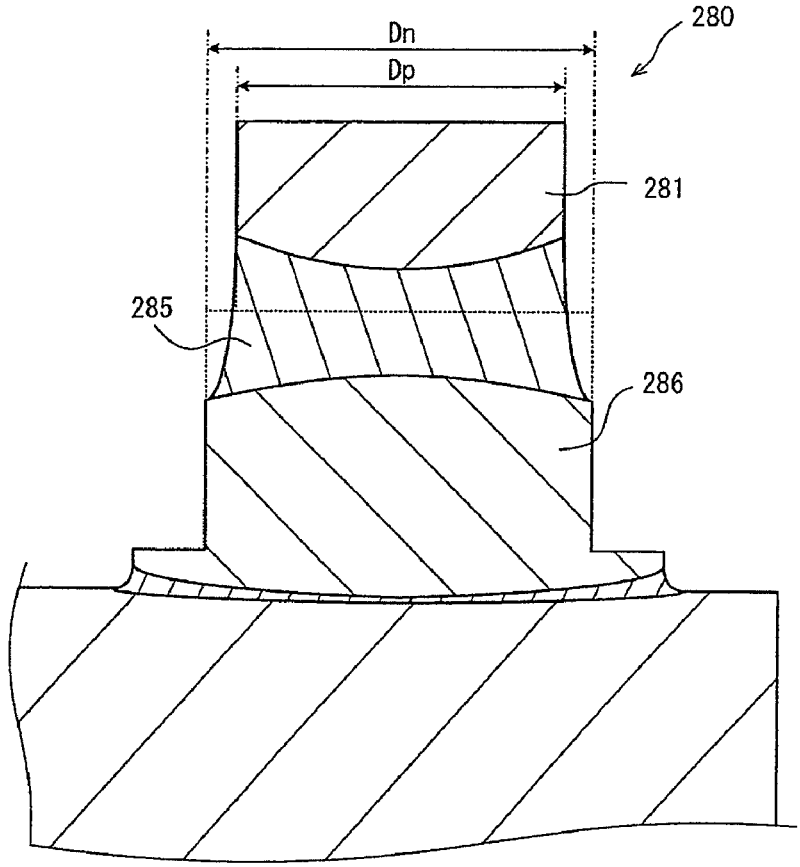
FIG. 5 is an enlarged section view of a spark section 280 according to the modified embodiment of the present invention.

As shown in FIG. 5, there can be used a spark section 280 in which a noble metal member 281 has an outer diameter Dp smaller than an outer diameter Dn of an intermediate member. Further, a fused joint 285 may be formed between the noble metal member 281 and the intermediate member 286 so as to be continuous in the cross section of the spark section 280 along the mating faces of these members.

The invention claimed is:

1. A spark plug, comprising:

a center electrode;

a ceramic insulator having an axial hole extending in an axial direction and retaining the center electrode in the axial hole;

a metal shell circumferentially surrounding and retaining therein the ceramic insulator;

a ground electrode joined at one end portion thereof to a front end face of the metal shell and bent in such a manner that a side surface of the other end portion of the ground electrode faces a front end portion of the center electrode; and a spark section joined to the side surface of the other end portion of the ground electrode at a position facing the front end portion of the center electrode and protruding 0.6 to 1.6 mm from the side surface toward the center electrode, the spark section comprising:

an intermediate member containing nickel as a main component, joined to the side surface and protruding toward the center electrode;

a noble metal member containing a noble metal as a main component and joined to a protruding end of the intermediate member so as to define a spark gap between the noble metal member and the front end portion of the center electrode, a portion of the noble metal member adjacent to a fused joint between the noble metal member and the intermediate member having an outer diameter Dp of 0.5 to 1.2 mm, wherein a thermal conductivity of the intermediate member is lower than a thermal conductivity of the noble metal member.

2. The spark plug according to claim 1, wherein the thermal conductivity of the intermediate member is in a range of 10 to 25 W/(m·K).

3. The spark plug according to claim 1, wherein the intermediate member has a length of 0.2 to 1.4 mm in a protruding direction thereof from the side surface.

4. The spark plug according to claim 1, wherein the spark section satisfies a relationship of $-0.1 \leqq Dn-Dp \leqq 0.5$ where Dn is an outer diameter of the intermediate member before being joined.

5. The spark plug according to claim 1, wherein the fused joint is formed by laser welding or electron beam welding; and wherein a cross section of the spark section taken through a center axis of the spark section has a contour including a segment of either linear shape or arc shape concave toward the center axis at a position corresponding to the fused joint.

6. The spark plug according to claim 5, wherein the spark section satisfies a relationship of $Sy/Sn \geqq 0.55$ where Sy is an area of a cross section of the spark section taken perpendicular to the center axis and including the fused joint at a position that the area of the cross section becomes minimum; and Sn is an area of a cross section of the spark section taken perpendicular to the center axis and including only the intermediate member at a position closest to the fused joint in a direction of the center axis.

* * * * *